US007182152B2

(12) United States Patent
Lange

(10) Patent No.: US 7,182,152 B2
(45) Date of Patent: Feb. 27, 2007

(54) SAMPLING ISOLATOR

(75) Inventor: James E Lange, LaPorte, IN (US)

(73) Assignee: Diedrich Drill, Inc., LaPorte, IN (US)

( * ) Notice: Subject to any disclaimer, the term of this patent is extended or adjusted under 35 U.S.C. 154(b) by 155 days.

(21) Appl. No.: 10/683,970

(22) Filed: Oct. 10, 2003

(65) Prior Publication Data

US 2004/0079555 A1 Apr. 29, 2004

Related U.S. Application Data

(60) Provisional application No. 60/418,648, filed on Oct. 15, 2002.

(51) Int. Cl.
*E21B 49/00* (2006.01)

(52) U.S. Cl. ..... 175/58; 175/249; 166/177.6

(58) Field of Classification Search ..... 175/58, 175/59, 249, 253, 245, 332; 73/864.44; 166/177.6
See application file for complete search history.

(56) References Cited

U.S. PATENT DOCUMENTS 1,923,132 A * 8/1933 Witkin ..... 464/20
2,989,130 A * 6/1961 Mathewson, Jr. et al. .... 175/56
4,023,628 A 5/1977 Bodine
4,217,753 A 8/1980 Loretan
4,403,665 A 9/1983 Bodine
4,693,325 A 9/1987 Bodine
4,836,299 A 6/1989 Bodine
5,027,908 A 7/1991 Roussy
5,086,854 A 2/1992 Roussy
5,116,147 A * 5/1992 Pajari, Sr. ..... 384/615
5,409,070 A 4/1995 Roussy
5,417,673 A 5/1995 Gordon
5,549,170 A * 8/1996 Barrow ..... 175/55
5,562,169 A 10/1996 Barrow (Continued)

OTHER PUBLICATIONS

"Disc Springs", undated, 1 page.

(Continued)

*Primary Examiner*—Jennifer H. Gay
*Assistant Examiner*—Nicole A Coy
(74) *Attorney, Agent, or Firm*—Baker & Daniels LLP

(57) ABSTRACT

A soil sampling system that in one embodiment includes a drill rod, a sampler or core barrel and an adapter coupling, for connecting the sampler barrel to the drill rod. In one embodiment the drill rod provides vibratory drilling movement, and the sampler barrel collects soil samples. The adapter coupling may include a barrel adapter for attaching the adapter coupling to the sampler barrel, a rod adapter for connecting the adapter coupling to the drill rod, and an isolating mechanism to isolate the sampler barrel from any upward vibratory movement of said drill rod. As such, the sampler barrel receives only downward motion from the drill rod. In one embodiment, the isolating mechanism of the soil sampling system includes an isolator box connected to the rod adapter. The soil sampling system may also include an isolator pin attached to the barrel adapter. In an embodiment of the soil sampling system, the rod adapter drives the isolator pin during a downward stroke of said drill rod. Then, the rod adapter lifts away and is removed from the isolator pin on an upward stroke of the drill rod. The isolator box maintains a coupling allowing relative movement between the rod adapter and the isolator pin.

17 Claims, 5 Drawing Sheets

U.S. PATENT DOCUMENTS

| | | | | |
|---|---|---|---|---|
| 5,601,152 | A | 2/1997 | Harrison | |
| 5,771,985 | A | 6/1998 | Jaworski | |
| 5,996,712 | A * | 12/1999 | Boyd | 175/321 |
| 2002/0117334 | A1 | 8/2002 | Smith et al. | |

OTHER PUBLICATIONS

"Mechanisms simplify timing between shafts", undated, pp. 262-263.

Harris, Cyril M., "Shock and Vibration Handbook", undated, pp. 25.1-25.7, Fourth Edition.

"General Fundamentals", undated, pp. 1-13.

"Mutually-opposed springs", undated, p. 15.

Boart Longyear Company, "Environmental Drilling Division: Sonic Drilling", undated, pp. 1-11.

"Sonic Drilling Ltd.", undated, p. 2, Industry in Action.

* cited by examiner

SAMPLING ISOLATOR

This application claims the benefit of U.S. Provisional Patent application Ser. No. 60/418,648 filed Oct. 15, 2002, the complete disclosure of which is hereby expressly incorporated by reference.

BACKGROUND OF THE INVENTION

The present invention relates to a device to assist in retrieving geotechnical and environmental soil samples, and in particular, to an adapter coupling for connecting a soil sampling barrel to a drill rod wherein the adapter coupling allows the sampling barrel to receive only downward motion of a vibrating drill rod.

Earth probing for environmental and geotechnical soil sampling has become increasingly necessary. Samples may be taken by drilling into the earth and taking samples at predetermined depths, or by driving samplers into the earth. Where possible, driving samplers directly is usually less expensive and more convenient than drilling. Often, a number of samplers must be driven at a site, and it is desirable that these samplers be installed as quickly as possible. Sonic drilling is a fast way of driving samplers, in which vibratory energy is applied to a drill rod at a resonate frequency which multiplies the force applied at the drilling spindle many times as it is transmitted to a bit within the ground and also tends to fluidize or break apart the surrounding particles in the earth. Since the frequency of the vibrations is normally 50–150 Hertz, which is in the sonic range, installation of samplers in the ground by applying vibratory energy is commonly referred to as "sonic drilling." Sonic drilling permits installation of samplers at a very rapid rate. In addition to earth probing, sonic energy can be used to facilitate installation of other objects into the ground.

Samplers used to obtain geotechnical and environmental soil samplers typically use a split barrel design. A complete split barrel sampler assembly consists of a drive shoe for driving into the soil, a two-piece split barrel sampler, and an adapter coupling. The split barrel sampler is a tubular member, typically having a round cross-section, split lengthwise to facilitate removal of soil samples contained therein after it is driven in the earth. Typically both ends of the split barrel sampler are externally threaded, and the drive shoe contains a tapered tip on one end for effectively cutting through soil, and an internal thread on the opposite end for mating with the split barrel sampler.

Typically the split barrel is attached to a drill rod with an adapter coupling that has internal threads on one end for mating with the drill rod and internal threads on the opposite end for mating with the split barrel.

If the sampler is vibrated into the ground, as occurs with sonic drilling, the up and down motion may cause the sample to be disturbed. Since it is important for accurate samples to be taken, this disturbance can make the soil sample suspect. In addition, the up and down vibrator motion of a sonic drill generates a tremendous amount of friction and associated heat between the barrel sampler and the ground that may affect the integrity of the sample.

Therefore, it is an object of the invention to provide a soil sampling system that minimizes the amount of disturbance of soil samples taken with the vibratory drill. It is another object of the invention to provide a soil sampling system for reducing the amount of friction between the barrel sampler and the ground. It is another object of the invention to accomplish these goals by providing a soil sampling system wherein the vibratory drill only drives the barrel sampler in the downward direction during the drilling process.

SUMMARY OF THE INVENTION

The objects of the invention have been accomplished by providing a soil sampling system that in one embodiment includes a drill rod, a sampler or core barrel and an adapter coupling for connecting the soil sampler barrel to the drill rod. In one embodiment the drill rod provides vibratory drilling movement, and the sampler barrel collects soil samples. The adapter coupling may include a barrel adapter for attaching the adapter coupling to the sampler barrel, a rod adapter for connecting the adapter coupling to the drill rod, and an isolating mechanism to isolate the sampler barrel from any upward vibratory movement of the drill rod. As such, the sampler barrel receives only downward motion from the drill rod.

In one embodiment, the isolating mechanism of the soil sampling system includes an isolator box connected to the rod adapter. The soil sampling system may also include an isolator pin attached to the barrel adapter.

It is also a feature of an embodiment of the soil sampling system that the rod adapter drives the isolator pin during a downward stroke of said drill rod. Then, the rod adapter lifts away and is removed from the isolator pin on an upward stroke of the drill rod. The isolator box maintains a coupling allowing relative movement between the rod adapter and the isolator pin.

Another feature of an embodiment of the soil sampling system is that the isolator box includes a lip, and the isolator pin includes a shoulder. A gap is defined between the lip of the isolator box and the shoulder of the isolator pin. The gap is wider than the total amplitude of a vibration stroke of said drill rod. The gap being the widest when the rod adapter is in contact with the isolator pin on a downward stroke of the drill rod.

An additional feature of one embodiment of the invention is that the isolator pin of the soil sampling system is connected to the barrel adapter with a threaded connection. The threaded connection is compressed with bolts. The bolts extend through threaded bores in the isolator pin and are turned against an end of the adapter barrel.

This summary is intended only as an aid in describing some of the features of the invention which are more fully described in the following detailed description and attached figures. The summary is not intended to limit the invention in any manner as the invention resides not in any of these features per se, but rather as defined by the attached claims.

BRIEF DESCRIPTION OF THE DRAWINGS

The above-mentioned and other features and objects of this invention and the manner of obtaining them will become more apparent and the invention itself will be better understood by reference to the following description of an embodiment of the present invention taken in conjunction with the accompanying drawings, wherein.

Figure 1:
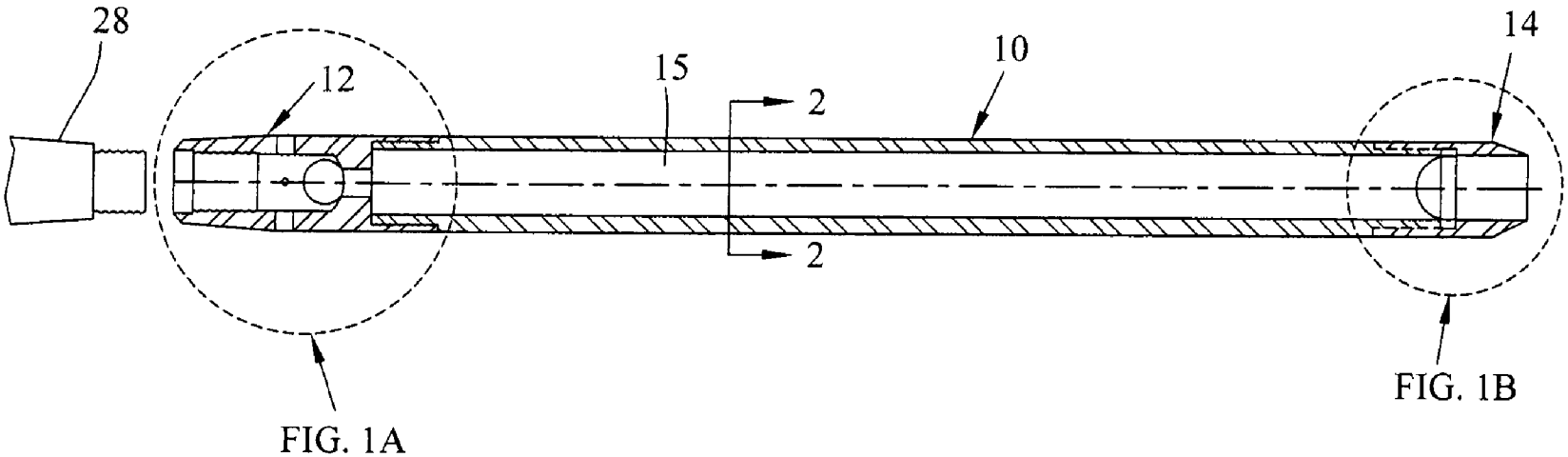
FIG. 1 (PRIOR ART)
FIG. 1 is a cross-sectional view of prior art split barrel sampler assembly.

Corresponding reference characters indicate corresponding parts throughout the several views. Although the drawings represent embodiments of the present invention, the drawings are not necessarily to scale and certain features may be exaggerated in order to better illustrate and explain the present invention. The discussion that follows illustrates certain embodiments of the invention and is not to be construed as limiting the scope of the invention in any manner.

DETAILED DESCRIPTION OF THE PREFERRED EMBODIMENT

The embodiments disclosed below are not intended to be exhaustive or to limit the invention to the precise forms disclosed in the detailed description. Rather, the embodiments are chosen and described so that others skilled in the art might utilize their teachings.

The present invention may be utilized with a conventional drill rig such as is illustrated in commonly owned U.S. Pat. No. 5,360,072, incorporated in its entirety herein by reference. In addition, the present invention is particularly suited for use with drills of a vibratory nature such as is disclosed, for example, in U.S. Pat. Nos. 5,027,908 and 5,409,070 to Roussy and in commonly owned U.S. Pat. No. 6.739,410 , all of which are incorporated in their entirety herein by reference.

The vibratory drill is used to drive a conventional split barrel core sampler generally indicated as 10, as is well known in the art, and shown in FIG. 1. A prior art adapter coupling generally indicated as 12 is connected to one end of the core sampler and a drive shoe generally indicated as 14 is connected to the other end.

Figure 1A:
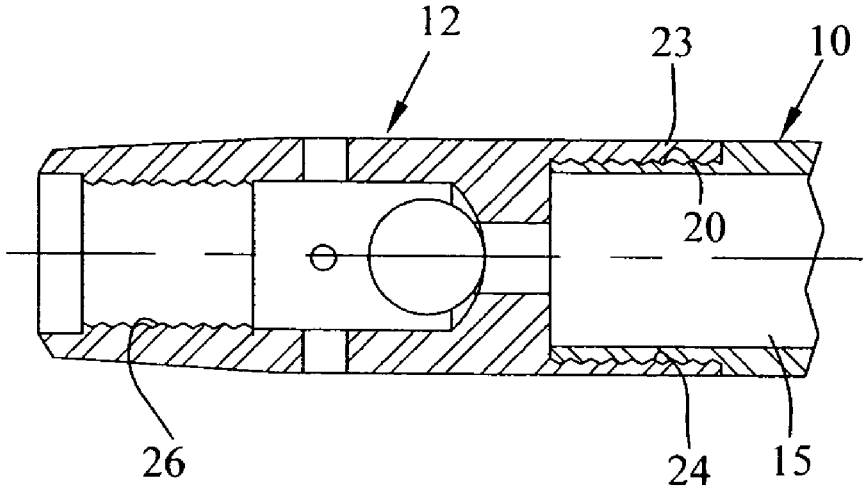
FIG. 1A (PRIOR ART)
FIG. 1A is a close up view of a prior art adapter connected to a split barrel core sampler.
Figure 1B:
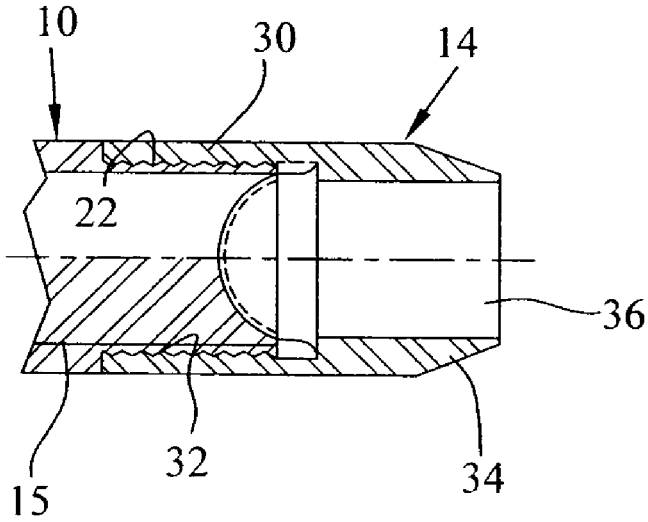
FIG. 1B (PRIOR ART)
FIG. 1B is a close up view of a drive shoe connected to the split barrel core sampler.
Figure 2:
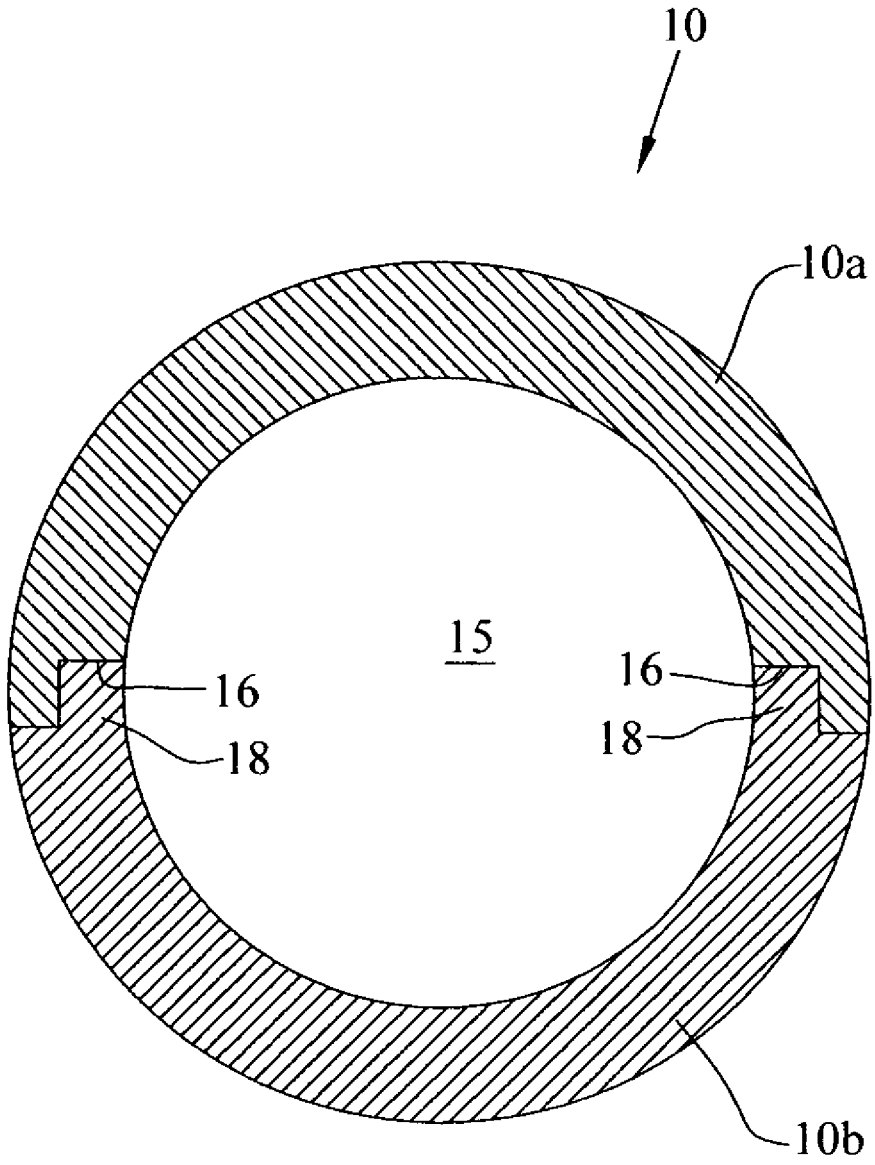
FIG. 2 (PRIOR ART)
FIG. 2 is a cross-sectional view of the split barrel core sampler taken along line 2—2 of FIG. 1.

As shown in FIG. 2, split barrel core sampler 10 is constructed of two longitudinally extending cylindrical halves 10*a*, 10*b* defining an inner bore 15. Half 10*a* has a groove or notch 16 located along the edges of the half cylinder along the length thereof and towards the internal diameter of the half. Grooves 16 mate with corresponding longitudinally extending tongues 18 located along the inner diameter edges of half 10*b*. Grooves 16 and tongues 18 interlock to prevent lateral movement of the halves with respect to one another. Split barrel core sampler 10 also has opposite externally threaded ends 20, 22 for connecting the core sampler to the adapter coupling 12 and drive shoe 14, respectively (FIGS. 1A and 1B). The sampling assembly is typically manufactured from a steel such as 4140.

Adapter coupling 12 has an extension 23 on one end thereof having internal threads 24 for mating with external threads 20 of split barrel core sampler 10 as shown in FIG. 1A. The opposite end of adapter coupling 12 has an internally threaded bore 26 for connection to a drill rod 28 (FIG. 1).

Referring to FIG. 1B, drive shoe 14 has an extension 30 on one end thereof having internal threads 32 for mating with external threads 22 of split barrel core sampler 10. The opposite end 34 of drive shoe 14 is tapered to facilitate driving the drive shoe into the ground. A hollow bore 36 extends through drive shoe 14 for receiving a soil sample (not shown) and allowing it to pass through to split barrel core sampler 10.

Figure 3:
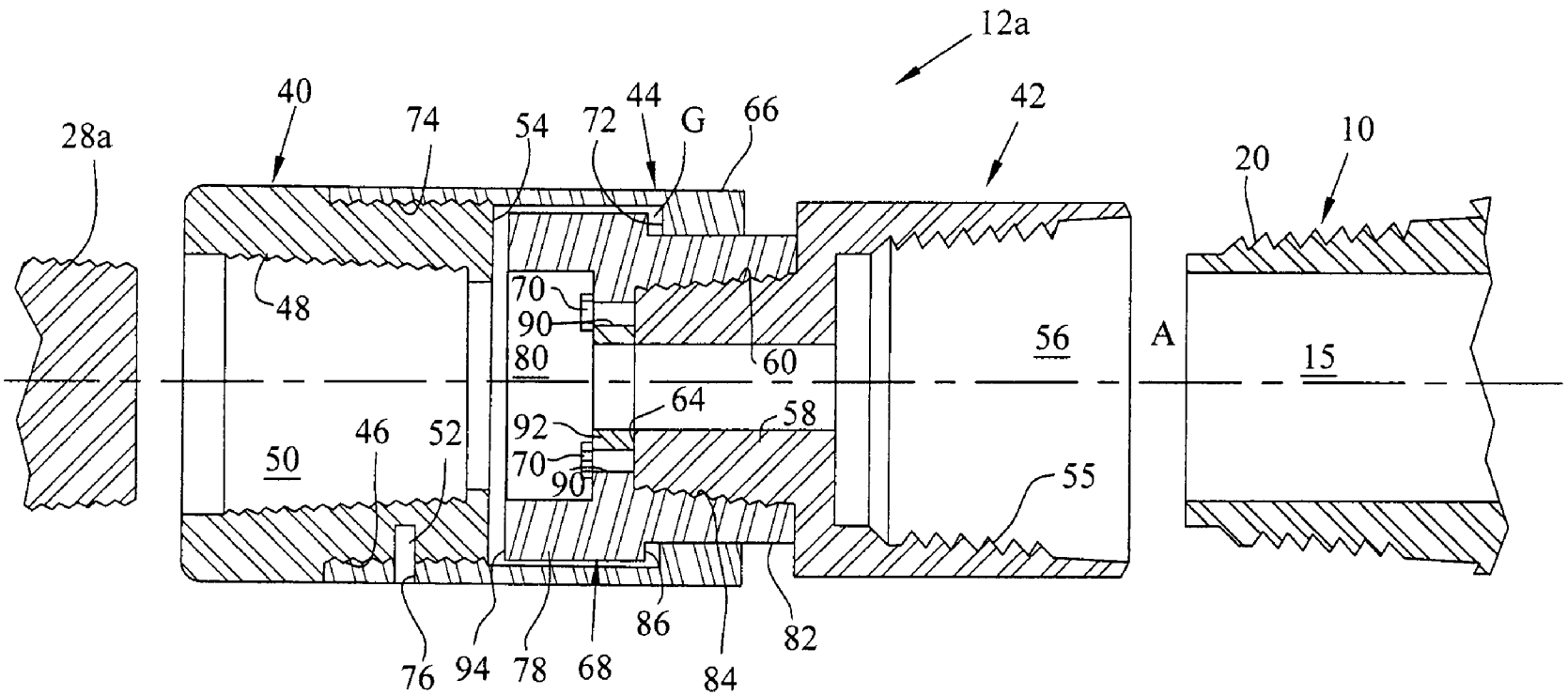
FIG. 3 is a cross-sectional view of an adapter coupling with the drill rod in the upstroke position.
Figure 4:
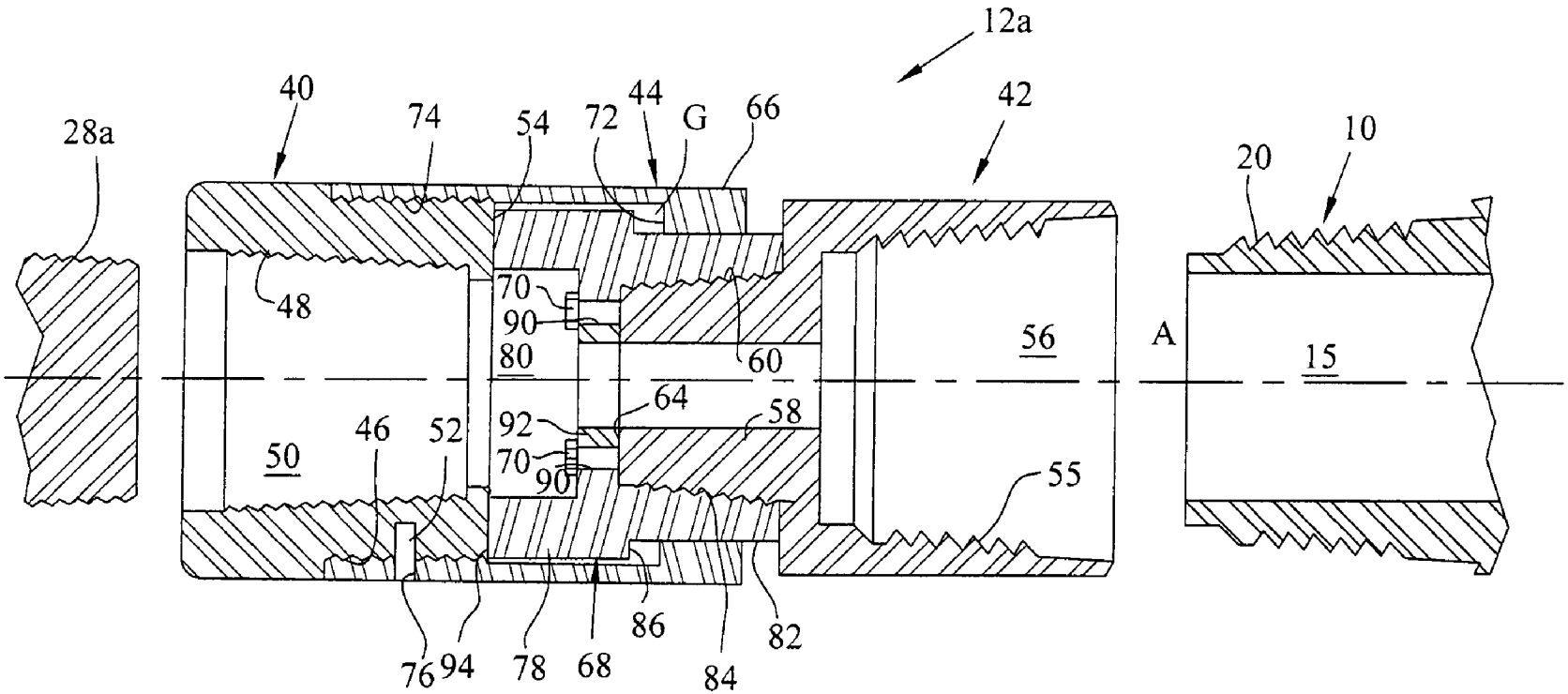
FIG. 4 is an adapter coupling with the drill rod in the downstroke or driving position.

Now referring to FIGS. 3 and 4, an isolating adapter coupling of the present invention, generally indicated as 12*a*, is shown. Isolating adapter coupling 12*a* includes a rod adapter generally indicated as 40, a core barrel adapter, generally indicated as 42 and an isolating mechanism, generally indicated as 44. The rod adapter 40 has external threads 46 located on one end for connection to isolating mechanism 44, and internal threads 48 extending partially through a bore 50 to the opposite end of the rod adapter for connection to a drill rod 28*a*. The rod adapter 40 also includes a bore 52 extending through external threads 46 for use in securing the isolating mechanism 44 to the rod adapter. Rod adapter 40 also has a generally flat end surface 54 on the end of the adapter having external threads 46.

Core barrel adapter 42 includes internal threads 55 extending through a bore 56 in one end thereof for use in connecting split barrel core sampler 10 to the adapter coupling 12*a*. The opposite end of the core barrel adapter 42 has a tapered protrusion 58 extending therefrom having external threads 60 for connection to isolating mechanism 44. Core barrel adapter 42 also has a generally flat surface 64 on the end of tapered protrusion 58.

Isolating mechanism 44 includes an isolator box generally indicated as 66, an isolator pin generally indicated as 68, and securing bolts 70. Isolator box 66 is a cylindrical sleeve having an inwardly extending lip or flange 72 around one end of the inner circumference thereof. The opposite end of isolator box 66 has internal threads 74 configured to mate with external threads 46 on rod adapter 40. Isolator box 66 also includes an aperture 76 configured to be aligned with bore 52 of rod adapter 40 for securing the threaded engagement between the isolator box and the rod adapter.

Isolator pin 68 has a generally cylindrical configuration and includes a main portion 78 having a counterbore 80 and an extension 82 having an internally threaded tapered bore 84 configured to mate with threads 60 of the core barrel adapter 42. The transition point between the main portion 78 of isolator pin 68 and extension 82 is defined by a shoulder 86. Isolator pin 68 also includes a plurality of threaded apertures 90 in a central web portion 92 of the isolator pin for receipt of securing bolts 70. On the end of isolator pin 68 opposite extension 82 is a generally flat end surface 94 for engaging surface 54 of rod adapter 40.

The above described embodiment for a soil sampling system may be assembled by inserting isolator pin 68 into isolator box 66 as shown in FIGS. 3 and 4. The rod adapter 40 is then threaded into the isolator box 66 by screwing the respective threads 46 and 74 together. The threaded engagement is secured by inserting a locator or dowel pin (not shown) through aperture 76 and into bore 52. Next, the core barrel adapter 42 can be screwed into extension 82 of the isolator pin 68 with the respective threads 60 engaging the threads of tapered bore 84. The threaded engagement between the core barrel adapter 42 and the isolator pin 68 is maintained by threading bolts 70 through respective apertures 90 in web 92 of the isolator pin and turning or torquing the bolts against end surface 64 of nose 58. This will put threads 60 and the threads on tapered bore 84 in a compressive state that may be less susceptible to fatigue than in a normally torqued threaded joint.

This completes the assembly of the isolating adapter coupling 12*a*. The isolating adapter coupling can then be connected to the drill rod 28*a* by threading external threads on the end of the drill rod with threads 48 in bore 50. The isolating adapter coupling is connected to the split barrel core sampler 10 by screwing threads 20 into internal threads 55 in bore 56 of the core barrel adapter 42.

In operation, the drill rod 28*a* is connected to a spindle such as shown in commonly owned application Ser. No.

10/083,206 for a Sonic Drill Head. The sonic drill will cause the drill rod to vibrate in an up and down motion. The isolating adapter coupling 12*a* will isolate movement in the split barrel core sampler 10 such that it is only subject to downward movement of drill rod 28*a* and does not follow the upward movement of the drill rod. Isolation from the upward movement of drill rod 28*a* is possible because the external diameter of the main portion 78 of isolator pin 68 is smaller than the inside diameter of the isolator box 66 and the outside diameter of extension 82 of isolator pin 68 is smaller than inner diameter of lip 72 of isolator box 66, allowing relative movement between said isolator pin and said isolator box along a longitudinal axis A that is aligned with the axis of the drill rod 28*a* and the split barrel core sampler 10. It should be noted, however, that there is an interference between lip 72 of isolator box 66 and shoulder 86 of isolator pin 68 such that the adapter coupling will not become separated during use.

A varying gap G is defined between lip 72 of isolator box 66 and shoulder 86 of isolator pin 68. Gap G is at its widest point at the peak of the downstroke of the drill rod as shown in FIG. 4 and at its narrowest when the drill rod is in the peak of an upstroke as seen in FIG. 3. In order to assure that the split barrel core sampler 10 does not receive any movement on the upward stroke of the drill rod, the gap G at the widest point must be greater than the total amplitude of a vibration stroke of the drill rod.

It can be seen that in downstroke of the drill rod as shown in FIG. 4 that driving movement may be imparted from the drill rod 28*a* to the split barrel core sampler 10 through rod adapter 40 and isolator pin 68. On the downward stroke, the end or lower surface 54 of the rod adapter is engaged with the upper end surface 94 of the isolator pin 68 such that the movement is transferred through the isolator pin and core barrel adapter 42 to the split barrel core sampler 10 and drive shoe 14.

Use of the subject isolating adapter coupling provides a tremendous reduction in the amount of travel and subsequent friction/heat build up in a soil sample when drilling with a vibratory or sonic drill. For example, the sonic drill described in commonly owned application Ser. No. 10/083,206 for the Sonic Drill Head may vibrate at 180 cycles per minute with a total amplitude of travel of 0.0375 inches. In a typical sampling time of about 90 seconds for driving in a five foot sample, the core barrel would travel approximately 1,017.5 feet without the isolating adapter coupling in place (180 cycles per second×90 seconds×2 (up and down)×0.375 inches plus the five feet of sample depth). With the isolator adapter coupling, the same core barrel will travel only the five foot sample depth. The proximate difference in the travel is about 203.5 times greater than without the isolator adapter coupling (1,017.5 feet divided by 5 feet), such that a significant reduction in the heat from friction should be realized with the present invention.

With a more conventional vibratory drilling unit, the reduction in travel of the core barrel by using the isolating adapter coupling will still be significant, although somewhat less. For example, a typical unit may vibrate at a frequency of 135 cycles per second with a total amplitude of vibration of 0.25 inches. If the sampling time remained at 90 seconds, the core barrel would travel 511.25 feet in obtaining the five foot soil sample (135 cycles per second×90 seconds×2 (up and down)×0.025 inches plus the five sample feet). With the isolating adapter coupling 12*a* of the invention, the core barrel would again travel only the five feet of soil sampling depth. As such, with a typical vibratory drill, the core barrel will travel 102.3 times less with an isolating adapter coupling than without (511.25 feet divided by 5 feet).

While the invention has been taught with specific reference to the above embodiment, someone skilled in the art will recognize that changes can be made in form and detail without departing from the spirit and scope of the invention. For example, other materials may be used, and the threads may be altered from part to part as to which part has external and which part has internal threading. Also, the threaded connection between the isolator pin and the core barrel adapter may be torqued with a conventional torque wrench in lieu of using bolts 70. Additionally, other configurations of the members of the isolating adapter coupling may be utilized that perform the same function. Therefore, the described embodiments are to be considered in all respects only as illustrative and not restrictive. The scope of the invention is, therefore, indicated by the following claims rather than by the description.

The invention claimed is:

1. An adapter coupling for connecting a soil sampler barrel to a drill rod, said adapter coupling comprising a barrel adapter for attaching said adapter coupling to the sampler barrel, an isolator pin attached to said barrel adapter, a rod adapter for connecting said adapter coupling to the drill rod, and an isolating mechanism including an isolator box connected to said rod adapter to isolate the sampler barrel from any upward vibratory movement of the drill rod so that the sampler barrel receives only downward motion from the drill rod, and said rod adapter driving said isolator pin during a downward stroke of the drill rod.

2. The adapter coupling as set forth in claim 1, wherein said rod adapter lifts away from said isolator pin on an upward stroke of the drill rod while said isolator box maintains a coupling therebetween, allowing relative movement between said rod adapter and said isolator pin.

3. The adapter coupling as set forth in claim 2, wherein said isolator box includes a lip and said isolator pin includes a shoulder.

4. The adapter coupling as set forth in claim 3, including a gap between said lip of said isolator box and said shoulder of said isolator pin, said gap being slightly wider when said rod adapter is in contact with said isolator pin than the total amplitude of a vibration stroke of said drill rod.

5. The adapter coupling as set forth in claim 1, wherein said isolator pin is connected to said barrel adapter with a threaded connection and said threaded connection is secured with bolts.

6. The adapter coupling as set forth in claim 5, wherein said bolts extend through threaded apertures in said isolator pin and are turned against an end of said barrel adapter.

7. A soil sampling system comprising a drill rod, a sampler barrel and an adapter coupling for connecting said sampler barrel to said drill rod, said adapter coupling including a barrel adapter for attaching said adapter coupling to said sampler barrel, an isolator pin attached to said barrel adapter, a rod adapter for connecting said adapter coupling to said drill rod, and an isolating mechanism including an isolator box connected to said rod adapter to isolate said sampler barrel from any upward vibratory movement of said drill rod so that said sampler barrel receives only downward motion from said drill rod, and said rod adapter driving said isolator pin during a downward stroke of said drill rod.

8. The soil sampling system as set forth in claim 7, wherein said rod adapter lifts away from said isolator pin on an upward stroke of said drill rod while said isolator box maintains a coupling therebetween, allowing relative movement between said rod adapter and said isolator pin.

9. The soil sampling system as set forth in claim 8, wherein said isolator box includes a lip and said isolator pin includes a shoulder.

10. The soil sampling system as set forth in claim 9, including a gap between said lip of said isolator box and said shoulder of said isolator pin, said gap being slightly wider when said rod adapter is in contact with said isolator pin than the total amplitude of a vibration stroke of said drill rod.

11. The soil sampling system as set forth in claim 7, wherein said isolator pin is connected to said barrel adapter with a threaded connection and said threaded connection is secured with bolts.

12. The soil sampling system as set forth in claim 11, wherein said bolts extend through threaded apertures in said isolator pin and are turned against an end of said barrel adapter.

13. An adapter coupling for use with a vibratory drill, said adapter coupling comprising a rod adapter for connection to a drill rod, a barrel adapter for connection to a sampler barrel, and an isolating means, including an isolator box connected to said rod adapter and an isolator pin connected to said barrel adapter, for isolating movement of said sampler barrel from upward vibratory movement of said drill rod, said rod adapter driving said isolator pin during a downward stroke of said drill rod.

14. The adapter coupling as set forth in claim 13, wherein said rod adapter is removed from said isolator pin on an upward stroke of the drill rod while said isolator box maintains a coupling therebetween, allowing relative movement between said rod adapter and said isolator pin.

15. The adapter coupling as set forth in claim 13, wherein said isolator box includes a lip and said isolator pin includes a shoulder.

16. The adapter coupling as set forth in claim 15, including a gap between said lip of said isolator box and said shoulder of said isolator pin, said gap being slightly wider when said rod adapter is in contact with said isolator pin than the total amplitude of a vibration stroke of said drill rod.

17. The adapter coupling as set forth in claim 13, wherein said isolator pin is connected to said barrel adapter with a threaded connection that is compressed with bolts extending through threaded apertures in said isolator pin, said bolts being turned against an end of said barrel adapter.

* * * * *